United States Patent [19]

Han

[11] 4,000,824

[45] Jan. 4, 1977

[54] TAPE CLOSURES

[75] Inventor: Hak Rhim Han, Stillwater, Minn.

[73] Assignee: Minnesota Mining and Manufacturing Company, St. Paul, Minn.

[22] Filed: July 24, 1975

[21] Appl. No.: 598,820

[52] U.S. Cl. ..... 215/232; 215/246

[51] Int. Cl.[2] ..... B65D 41/24

[58] Field of Search ..... 215/232, 246, 256

[56] References Cited

UNITED STATES PATENTS

| | | | |
|---|---|---|---|
| 1,877,606 | 9/1932 | Shoemaker | 215/246 |
| 2,885,105 | 5/1959 | Heyl | 215/246 |
| 2,954,139 | 9/1960 | Owens | 215/246 |
| 3,274,013 | 9/1966 | Batt | 215/246 |
| 3,827,591 | 8/1974 | Spelman | 215/246 |

FOREIGN PATENTS OR APPLICATIONS

| | | | |
|---|---|---|---|
| 606,256 | 8/1948 | United Kingdom | 215/246 |

*Primary Examiner*—Ro E. Hart

*Attorney, Agent, or Firm*—Alexander, Sell, Steldt & DeLaHunt

[57] ABSTRACT

For wine bottles and similar containers, an improved heat-shrunk film tape secondary closure of the type employing a tear strip to facilitate opening. The film is formed of certain acrylonitrile:methylacrylate or butadiene:styrene copolymers, which conform smoothly and tear cleanly, thereby enhancing the appearance of both the sealed and opened containers.

6 Claims, 3 Drawing Figures

TAPE CLOSURES

BACKGROUND OF THE INVENTION

This invention relates to an improved tape closure for sealed containers.

For many years secondary closures have been applied to lidded, stoppered, or capped containers by wrapping a strip of adhesive-coated shrinkable film around the container at the line of closure, thereafter heating the film to shrink the tape firmly and snugly in place; see, e.g., U.S. Pat. No. 3,405,833. It is also known to incorporate in the closure a tear strip which is positioned between the inner aspect of the tape and the container, along the line of closure, to facilitate opening; see, e.g., U.S. Pat. No. 3,873,018. The tear strip, which extends to the outer side of the closure, provides a convenient means for the user to rupture the tape seal and thereafter open the primary closure on the container.

As applied to wine bottles, for example, it is important that the secondary tape closure be aesthetically appealing both before and after opening. The closure should conform smoothly to both the neck of the bottle and that portion of the cork or cap which is adjacent the line of primary closure. Likewise, after the tape closure is ruptured by means of a tear strip, the line along which the tape has been severed should be sharp and even, enhancing the visual appeal of the opened container to the user.

Prior to the present invention, a wide variety of heat-shrinkable polymeric films have been employed as secondary tape closures, and while many have proved functionally satisfactory, none has been considered adequate from an aesthetic point of view. For example, either heat-shrinkable oriented polyethylene terephthalate film or unplasticized polyvinyl chloride film can be shrunk in place to provide an extremely attractive appearance before the closure is opened; when a tear strip is used to open seals made with these films, however, the line of rupture is irregular and unattractive, making such closures inherently unsatisfactory from the consumer's — and hence from the manufacturer's — point of view. On the other hand, films made of either atactic polystyrene or isotactic polypropylene, which tear along a straight line when employed in a closure, lack the ability to shrink so as to conform smoothly to the contours of the original bottle; the irregular appearance detracts from the aesthetic appeal of the product and tends to discourage its purchase by consumers.

Prior to the present invention, then, it is believed that there has not existed a tape closure for wine bottles and the like possessing aesthetic appeal both before and after opening of the bottle.

SUMMARY OF THE INVENTION

The present invention provides, for the first time, it is believed, a secondary heat-shrunk tape closure which is aesthetically appealing not only as originally prepared but also after it has been ruptured during the opening process. The closure is useful in connection with lidded tubs, screw top jars or bottles, stoppered bottles and similar containers.

The advantages set forth in the preceding paragraph are obtained when the tape closure is made with one of two specific types of dead-stretch films, viz., predominantly longitudinally oriented, hard, semi-rigid impact-modified acrylonitrile:methylacrylate copolymers and semi-rigid styrene-butadiene copolymers. The term "dead-stretch" means that if the film is stretched at room temperature, it displays substantially no elastic recovery. The term "semi-rigid" is intended to contrast with "rubbery", and indicates that the copolymers here employed are formed from monomers predominating, respectively, in acrylonitrile or styrene.

DESCRIPTION OF THE DRAWINGS

Understanding of the invention will be assisted by reference to the accompanying drawings, in which like numbers refer to like parts in the several views, and in which.

DESCRIPTION OF PRESENTLY PREFERRED EMBODIMENTS

Figure 1:
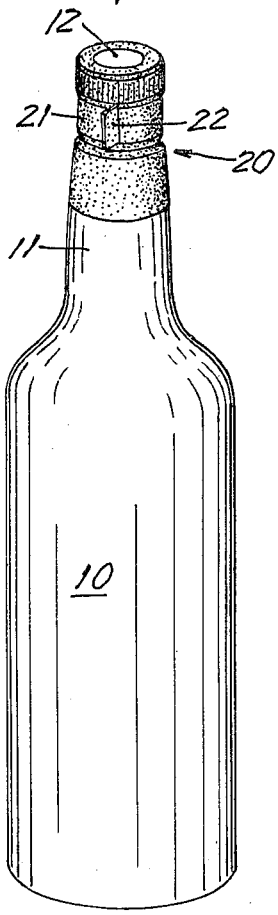
FIG. 1 depicts a bottle sealed with the secondary tape closure of the invention.
Figure 2:
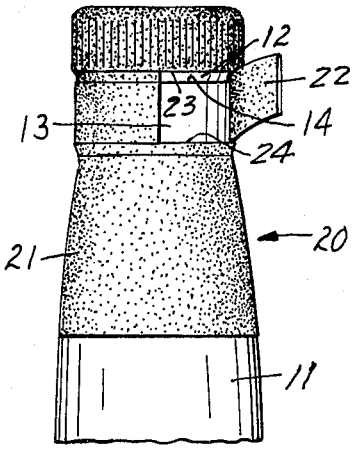
FIG. 2 is an enlarged view of the closure shown in FIG. 1, indicating the manner in which it is opened by means of a tear tape.
Figure 3:
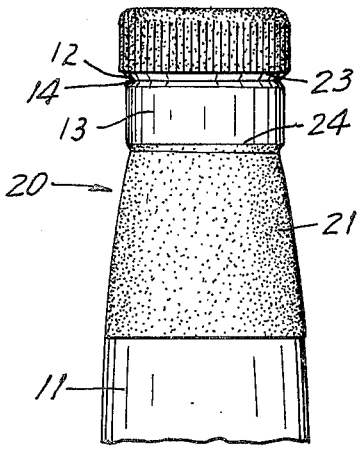
FIG. 3 shows the closure of the invention with the tear strip completely removed and the secondary closure thus entirely severed.

In the drawings, sealed wind bottle 10 includes neck portion 11, terminating in beveled lip 13. Headed stopper 12 which forms a primary closure for bottle 10, is inserted into and extends over the upper surface of lip 13, the diameters of the contiguous portions being substantially the same. The head of stopper 12 abuts lip 13 along primary closure line 14. Where the primary closure for the container is of some other configuration (e.g., a press-fit lid or a screw top jar), the primary closure line is considered to be the lower external edge of the primary closure.

Overlying the upper portion of neck 11, and extending entirely about the circumferential portion of lip 13 and stopper 12 is secondary tape closure 20, comprising adhesive-coated film 21 and tear strip 22. Film 21, which has been heat-shrunk snugly in place, also extends slightly over the top of stopper 12. Overlying primary closure line 14 and positioned primarily about the periphery of lip 13 beneath film 21 is tear strip 22, which extends entirely around lip 13 and protrudes slightly. When the user wishes to open sealed bottle 10, he grasps tear strip 22 and pulls it circumferentially around closure 20, thereby generating upper tear line 23 and lower tear line 24 in film 21. Tear lines 23 and 24, in accordance with the present invention, are substantially straight and provide sharp and attractive lines of demarcation.

In accordance with known technology, one of the heat-shrinkable films is provided on one surface with a low adhesion backsize coating and on the opposite surface with a pressure-sensitive adhesive coating, first applying a primer coating if necessary. The resultant heat-shrinkable adhesive tape product may then be slit into appropriate widths, each of which is wound convolutely upon itself about a core to form a roll. A narrow tear strip is then laminated to the adhesive side of the tape intermediate and parallel to, the lateral edges and the resultant laminate again wound into roll form. A suitable length of this laminated product is removed from the roll and wrapped around the upper neck and stopper of a closed wine bottle, the lower edge smoothly overlapping itself. The wrapped neck of the bottle is then placed about 7 inches (18 cm) away from a 400° F. (205° C.) hot air blast for three seconds, while the bottle is rotated on its axis at 120 rpm. During this process, the tape shrinks smoothly, conforming snugly to the bottle contours.

For test purposes, the laminated tape is wrapped snugly around the upper neck of a bottle which has first been closed with a screw cap, using the application technique just described. The heat-shrunken secondary tape closure is then examined carefully, noting the height of the lower edge of the closure; a deviation of less than 1 mm along the circumference is considered satisfactory. The closure is also examined carefully to determine whether it conforms smoothly to the neck and cap of the bottle. The presence of any detectable wrinkles, pouching, or bagginess is regarded as rendering the closure unsatisfactory.

In order to determine whether the tape closure will satisfy the aesthetic desires of a purchaser, a test was devised in which the bottle is mounted horizontally in a fixture and arranged to rotate freely about its axis. The fixture is mounted in the lower jaws of a tensile testing machine, and the tab of the tear tape grasped in the upper jaws. The upper and lower jaws are then separated at the rate of 20 inches (about 50 cm) per minute until the tear strip has been completely removed, the bottle rotating to maintain the linearity of pulling. The secondary closure is considered satisfactory if the upper and lower tear lines are sharp and there is no more than 1 mm deviation in width of the space between them.

The invention will now be further illustrated by means of a specific non-limiting example.

An impact-resistant 3:1 acrylonitrile:methylacrylate copolymer, made in the presence of about 8–10% of a rubbery 70:30 butadiene:acrylonitrile copolymer (commercially available from Vistron Corporation under the registered trademark designation "Barex" 210) was extruded into the nip formed by internally cooled counter-rotating rolls as a flat 4–5 mil (about 100–125 micron) strip. The barrel temperature of the extruder at the feed zone was kept at 340° F. (about 170° C.), and the die temperature was 415° F. (about 180° C.). The film was then oriented at a draw ratio of approximately 2.3:1 in the lengthwise direction, the ultimate thicknes being 2 mils (about 50 microns). The temperature at which the orientation processes were carried out was in the range of 200–230° F. (93°–110° C.), to maintain a film temperature or 200° F. (93° C.).

The oriented film was slit into rolls about 9 inches (23 cm) wide and provided with a polyvinyl carbamate low adhesion backsize on one face. The opposite face of the film was then primed with a blend of rubbery butadiene:styrene copolymer latex and water-soluble phenol-formaldehyde resin. After drying to remove water and solvent, the primed surface was coated with a heptane solution of a pressure-sensitive adhesive formed by compounding crude rubber, rubbery butadiene:styrene copolymer, and polyterpene tackifying resin, and thereafter evaporating the solvent. The resultant pressure-sensitive adhesive-coated tape was slit into 2 ⅛ inch (about 54 mm) widths, each of which was wound convolutely itself about a core to form a roll.

Along the adhesive-coated surface of the 2 ⅛ inch (about 54 mm) strip just described, at a location ⅝ inch (about 16 mm) from one edge and 1 ⅛ inch (about 28.5 mm) from the other edge, was laminated a ⅜ inch (about 9.5 mm) wide strip of unplasticized polyvinyl chloride film having a thickness of about 2 mils (50 microns).

When subjected to the performance tests previously described, the composite tape product conformed smoothly to the periphery of the capped wine bottle, showing no evidence of bagginess and displaying no perceptible variation in height of the lower edge. Upon removal of the tear strip, the upper and lower tear lines were straight and sharp, the width of the spacing between the upper and lower tear line being substantially constant throughout the circumference of the seal. If the copolymer film is additionally oriented 1.2:1 in the cross direction, performance is comparable and film integrity is improved.

When a product is made as just described, except that the acrylonitrile:methylacrylate copolymer is replaced by a 3:1 styrene:butadiene copolymer (commercially available from Phillips Petroleum Co. under the trade designation "K" Resin) and orienting the film in the longitudinal direction, at a 6:1 draw ratio, the seal performs in substantially the same manner.

When such other films as heat-shrinkable polyethylene terephthalate, polystyrene, polypropylene, and acrylonitrile:methylmethacrylate copolymer resins are employed, the performance of the finished product is such that tape seals do not pass one or more of the performance tests described.

It will be recognized, of course, that such well known features as the type of low adhesion backsize, primer, and pressure-sensitive adhesive employed are within the grasp of those having ordinary skill in the art. Similarly, the methods of extrusion, orientation, and coating do not per se constitute a part of this invention, and suitable procedures will suggest themselves to those possessing ordinary skill.

It will likewise be appreciated that the heat-shrinkable film can be dyed, pigmented or printed to impart a desired visual effect and that the tear strip may have the same or different appearance.

What is claimed is:

1. In a secondary closure of the type in which a pressure-sensitive adhesive-coated heat-shrunken polymeric film is wrapped around and snugly conformed to the peripheral contours of a primarily sealed container, along and immediately adjoining both sides of the line of primary closure, a tear strip interposed between the film and the container so as to abut or overlie the line of closure, removal of said tear strip serving to rupture the film when it is desired to open the closed container, the improvement which comprises the film being predominantly longitudinally oriented and formed from a copolymer selected from a class consisting of semi-rigid acrylonitrile:methylacrylate copolymer and semi-rigid styrene:butadiene copolymer, whereby the tape seal presents a smooth, uniform appearance and removal of the tear strip tears the film along two substantially straight parallel lines, enhancing the appearance of the container in both closed and opened condition.

2. The secondary closure of claim 1 wherein the heat-shrunken film is formed from an acrylonitrile:methylacrylate copolymer having an acrylonitrile:methylacrylate mole ratio of about 3:1 and containing a minor amount of rubbery impact modifier.

3. The secondary closure of claim 2 wherein the rubbery impact modifier is a butadiene:acrylonitrile copolymer and is present in an amount equal to about 8–10% of the acrylonitrile:methylacrylate copolymer.

4. The secondary closure of claim 1 wherein the heat-shrunken film is formed from a styrene-butadiene copolymer having a styrene:butadiene mole ratio of about 3:1.

5. In a laminated tape product of the type wherein a pressure-sensitive adhesive-coated heat-shrinkable film is provided with a narrower strip of strong film extending along a generally medial portion of the adhesive-coated face of said heat-shrinkable film, the improvement which comprises employing as said heat-shrinkable film an at least predominantly longitudinally oriented impact-modified semi-rigid acrylonitrile:methylacrylate copolymer, whereby said tape product possesses particular utility for making the secondary closure of claim 1.

6. In a laminated tape product of the type wherein a pressure-sensitive adhesive-coated heat-shrinkable film is provided with a narrower strip of strong film extending along a generally medial portion of the adhesive-coated face of said heat-shrinkable film, the improvement which comprises employing as said heat-shrinkable film an at least predominantly longitudinally oriented semi-rigid styrene:butadiene copolymer, whereby said tape product possesses particular utility for making the secondary closure of claim 1.

* * * * *